US011352198B1

(12) United States Patent
Denton

(10) Patent No.: US 11,352,198 B1
(45) Date of Patent: Jun. 7, 2022

(54) ASSEMBLIES FOR PROTECTING AUTOMOBILE PARTS

(71) Applicant: Triple D Corporation, Knoxville, TN (US)

(72) Inventor: Joseph Patrick Denton, Knoxville, TN (US)

(73) Assignee: JOE PATRICK DENTON, Knoxville, TN (US)

( * ) Notice: Subject to any disclaimer, the term of this patent is extended or adjusted under 35 U.S.C. 154(b) by 0 days.

(21) Appl. No.: 17/120,924

(22) Filed: Dec. 14, 2020

(51) Int. Cl.
*B65D 85/68* (2006.01)
*B65D 6/24* (2006.01)
*B65D 63/10* (2006.01)

(52) U.S. Cl.
CPC ..... *B65D 85/68* (2013.01); *B65D 11/1893* (2013.01); *B65D 63/10* (2013.01); *B65D 2585/6887* (2013.01)

(58) Field of Classification Search
CPC ..... B65D 6/18; B65D 11/18; B65D 11/1893; B65D 63/10; B65D 85/68; B65D 2585/6887; B65D 81/03; B65D 81/05; B65D 6/24
USPC ..... 206/335; 220/6, 429, 4.29; 229/67.1–67.4, 122
See application file for complete search history.

(56) References Cited

U.S. PATENT DOCUMENTS 4,429,826 A * 2/1984 Shedd ..... B65D 5/38 229/112
4,535,929 A * 8/1985 Sherman, II ..... B65D 5/103 229/142
5,088,599 A * 2/1992 Mahler ..... G11B 33/0494 229/125.125
6,508,484 B1 * 1/2003 Flemons ..... B65D 85/68 206/335
8,459,710 B1 * 6/2013 White ..... B65G 7/12 294/152

(Continued)

FOREIGN PATENT DOCUMENTS

GB 2363779 A * 1/2002 ..... B65D 65/06

OTHER PUBLICATIONS

NZ 243429 (Year: 1995).*

(Continued)

*Primary Examiner* — Bryon P Gehman
(74) *Attorney, Agent, or Firm* — McClure, Qualey & Rodack, LLP

(57) ABSTRACT

An assembly incorporates a main body having first and second side panels, an end panel, and first and second flaps. The end panel is disposed between the first and second side panels. The first and second flaps extend outwardly from corresponding lower edges of the first and second panels. The main body selectively exhibits a pre-assembled configuration, in which the first and second side panels, the end panel, and the first and second flaps are oriented in a first plane, and an assembled configuration, in which the first and second side panels are oriented in an overlying relationship with respect to each other with the end panel extending therebetween. The first and second flaps are overlapped and secured to form a base upon which the main body is supported as a freestanding structure. The main body defines, in the assembled configuration, a cavity configured to receive an automobile part.

14 Claims, 14 Drawing Sheets

(56) References Cited

U.S. PATENT DOCUMENTS

| | | | | |
|---|---|---|---|---|
| 8,474,614 | B2 * | 7/2013 | Hanson | A47G 27/0406 206/320 |
| D744,822 | S | 12/2015 | Piscopo | |
| 9,446,892 | B2 * | 9/2016 | Piscopo | B65D 81/03 |
| 10,233,005 | B1 * | 3/2019 | De Bonet | B65B 23/00 |
| 2011/0005647 | A1 * | 1/2011 | Campfield | B65D 65/10 150/154 |

OTHER PUBLICATIONS

"Cycling Tips BikeBox Offers a Fresh Take on Flying with Your Bike;" https://cyclingtips.com/2019/10/bikebox-travel-case/; 2022; pp. 1-12.

* cited by examiner

ASSEMBLIES FOR PROTECTING AUTOMOBILE PARTS

BACKGROUND

Technical Feld

The disclosure relates to the field of automobile parts and, more specifically, to assemblies for protecting automobile parts, such as during transport.

DESCRIPTION OF THE RELATED ART

Owing to the high price of new automobile parts, it is commonplace to replace a damaged part with a replacement (for example, salvaged) part. For instance, if a replacement door is needed, a ready supply of salvaged doors is often available at a salvage yard, at which a suitable door is removed from a donor automobile. Depending upon where the repair is to take place, the salvaged door may require transport across town or even across the country. Unfortunately, automobile doors tend to be large, heavy and subject to potential damage during transport.

In an effort to alleviate the potential for damage during transport, a number of techniques have been used. By way of example, a door may be wrapped with blankets and/or pads to provide a level of cushioning about the door. Alternatively, a door may be placed in a protective enclosure, such as shown in U.S. Design Pat. D744822. These techniques, while satisfactory in some respects, have not been able to address one or more perceived shortcomings, such as ease of use while providing enhanced protection for the door.

SUMMARY

Assemblies for protecting automobile parts are provided. In an example embodiment, the assembly comprises: a main body having a first side panel, a second side panel, an end panel, a first flap and a second flap, the end panel being disposed between the first side panel and the second side panel, the first flap extending outwardly from a lower edge of the first side panel, the second flap extending outwardly from a lower edge of the second side panel; the main body selectively exhibiting a pre-assembled configuration, in which the first side panel, the second side panel, the end panel, the first flap and the second flap are oriented in a first plane, and an assembled configuration, in which the first side panel and the second side panel are oriented in an overlying relationship with respect to each other with the end panel extending therebetween, and the first flap and the second flap are overlapped and secured to form a base upon which the main body is supported as a freestanding structure; and the main body defines, in the assembled configuration, a cavity configured to receive an automobile part.

In some embodiments, the main body further comprises a first linear fold disposed between the first side panel and the end panel.

In some embodiments, the main body further comprises a second linear fold disposed between the second side panel and the end panel.

In some embodiments, the main body further comprises a third linear fold disposed between the first side panel and the first flap.

In some embodiments, the main body further comprises a fourth linear fold disposed between the second side panel and the second flap.

In some embodiments, the main body is formed of a continuous piece of sheet material.

In some embodiments, the sheet material is fluted polypropylene sheet material having flutes oriented parallel to the third linear fold and the fourth linear fold.

In some embodiments, a removable floor insert is disposed, in the assembled configuration, in an overlying relationship with the first flap and the second flap.

In some embodiments, the floor insert extends from the end panel to an open end of the main body.

In some embodiments, the floor insert is formed of fluted polypropylene sheet material having flutes oriented perpendicular to an orientation of flutes of the first flap and the second flap.

In some embodiments, a plurality of through holes is formed in the main body, and each of the plurality of through holes is configured as a carry handle.

In some embodiments, a first securing assembly has a first securing component attached to the first side panel and a second securing component attached to the second side panel, the first securing component and the second securing component being configured to selectively engage each other to secure an automobile part within the cavity.

In some embodiments, the first securing component and the second securing component each include a corresponding latching mechanism of an automobile seat belt.

In some embodiments, the assembly further comprises a second securing assembly having a third securing component attached to the first side panel and a fourth securing component attached to the second side panel.

In some embodiments, the third securing component and the fourth securing component are configured to selectively engage each other to secure the automobile part within the cavity.

In some embodiments, when the first securing component and the second securing component are engaged, the first securing assembly spans across an open end of the main body.

In some embodiments, when the third securing component and the fourth securing component are engaged, the second securing assembly spans across an open top of the main body.

In some embodiments, the main body is a first main body defining a first cavity; the assembly further comprises a second main body defining a second cavity; and the first cavity is configured to receive, at least partially therein, the second main body.

In some embodiments, the second main body is identical to the first main body.

In some embodiments, the assembly further comprises a cart having a platform, an axle disposed under and mounted to the platform, a handle assembly extending upwardly from a first end of the platform, and a first strut and a second strut extending from opposing sides of the handle assembly to opposing sides of the platform; and spacing between the first strut and the second strut is configured to support the first side panel and the second side panel when the main body disposed on the platform.

In some embodiments, the cart further comprises a ramp downwardly extending from a receiving end of the platform.

In some embodiments, the cart further comprises a stabilizing component disposed under the platform, the stabilizing component being configured to contact a surface upon which the cart is positioned when in a loading position, at which a distal end of the ramp also is in contact with the surface, the stabilizing component being configured to receive thereon a foot of a user to stabilize the cart during loading.

In some embodiments, the cart further comprises a leverage component extending outwardly from the platform and away from the first end, the leverage component being configured to receive thereon a foot of a user to assist in rotating the platform about the axle.

BRIEF DESCRIPTION OF THE SEVERAL VIEWS OF THE DRAWINGS

A more complete understanding of the disclosure may be had by reference to the following Detailed Description when taken in conjunction with the accompanying drawings, in which like reference numerals indicate corresponding parts throughout the several views.

DETAILED DESCRIPTION

Figure 1:
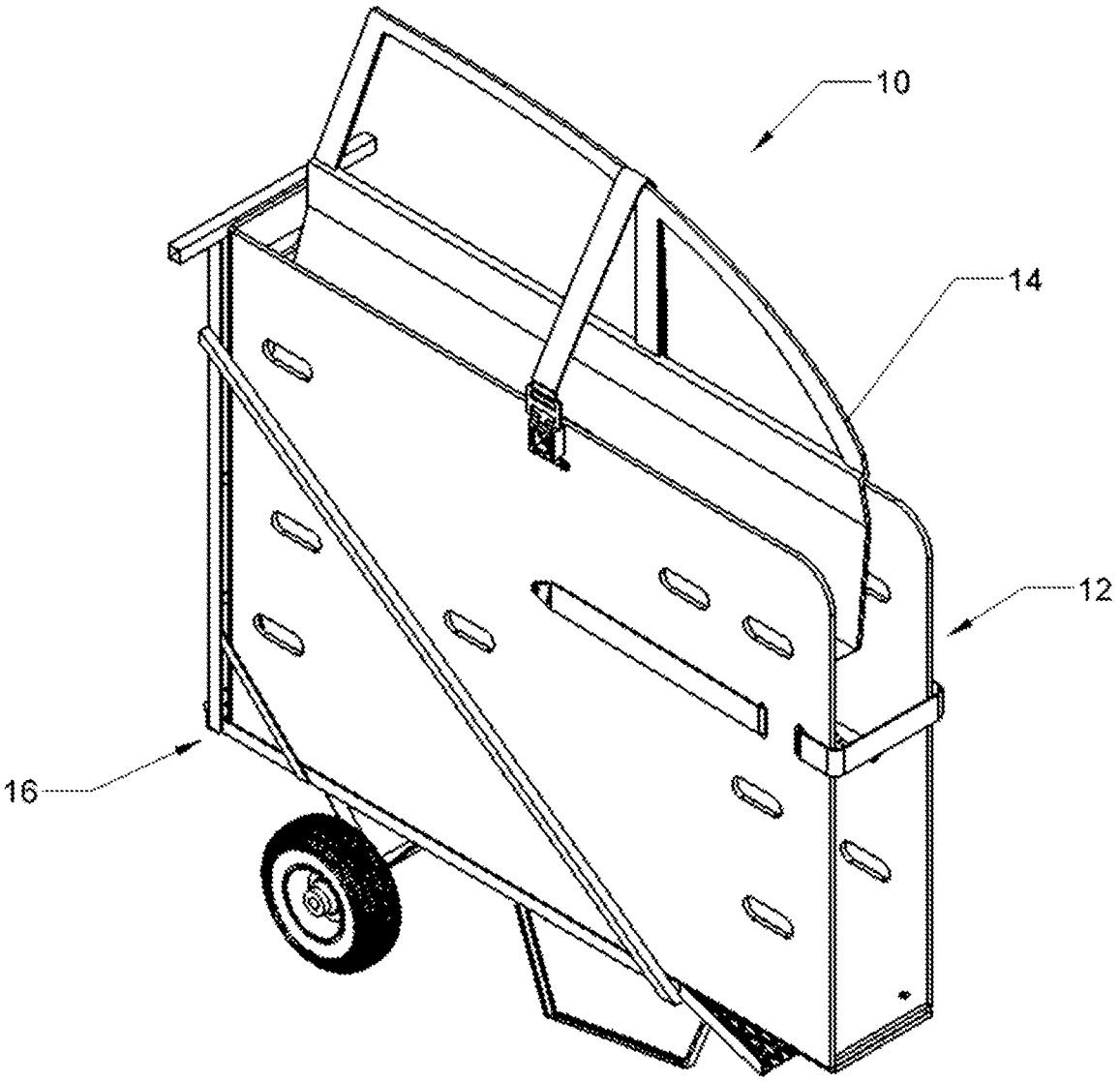
FIG. 1 is a schematic view of an example embodiment of an assembly.

Example embodiments of assemblies for protecting automobile parts are provided that involve the use of a freestanding (self-supporting) main body that defines a cavity into which a car or truck part may be placed. By way of example, such a part may be a door, fender, deck lid, or hood, among others. In use, such an assembly may securely enclose the part and provide protection during transport, with the freestanding structure permitting ease of use while a part is being placed into and/or removed from the main body. In some embodiments, the assembly includes a four-sided box (main body) with two open sides. Preferably, the main body is formed of corrugated plastic sheet material. One layer of the sheet material is positioned on each side to protect the part(s) from surface scratches and dents, and three layers of sheet material are layered on the bottom to protect the part(s) from damage if dropped. The sheet material of the main body is fastened together along with an easily replaceable floor insert, in some embodiments, to provide long-lasting durability.

In embodiments formed of corrugated plastic sheet material, the corrugations (or flutes) of the sheet material preferably are oriented to ensure appropriate weight distribution across the part to prevent damage. Specifically, on the sides of the main body, the flutes preferably run front-to-back to give the edges (or joints) between the sides and the bottom increased strength. The three layers of the sheet material on the bottom give both the carried part and the main body protection. For the top layer of three layers of sheet material of the floor insert, the flutes preferably run side-to-side, which tends to be perpendicular to the bottom of the carried part, thus distributing the part's weight evenly. The flutes of the bottom two layers of sheet material of the floor insert preferably run front-to-back to distribute the weight of the main body and any carried part(s) even if the assembly is not fully supported, such as when the main body extends over the edge of a delivery truck tailgate. In such an instance, the flutes running perpendicular to the delivery truck tailgate provide adequate weight distribution. In some embodiments, the three layers of sheet material are fastened together with bolts to prevent separation during transport. The bolts go all the way through the three layers and are exposed on the bottom. This allows the main body to be slid across a shop floor while protecting the bottom layer of the sheet material as the main body rides on the exposed portions of the bolts.

An assembly not only provides protection to a carried part(s) but also secures the part at least partially within the cavity so that the part and main body are movable together as a unit. In some embodiments, once a part is placed inside the cavity, one or more securing assemblies may be used to secure the part in place. In some embodiments, the securing assemblies may be configured as adjustable belts (for example, automobile seatbelts) to accommodate parts of various sizes. Preferably, a first securing assembly spanning across the top of the main body is used to ground the part to the floor insert of the main body and a second securing assembly is used to secure the part from sliding out of the open end of the main body. Preventing the part from moving relative to the main body gives the user more control when moving the assembly to a delivery truck for transport. Additionally, in those embodiments in which the securing assemblies incorporate belts and/or straps, these features may provide extra areas for grasping during movement.

In embodiments using automotive seatbelts to form the securing assemblies, associated quick-release connection buckles enable quick and easy securing and removal of a part from the main body. Preferably, securing assemblies are attached to the main body by using mechanical fasteners (for example, nuts and bolts). In some embodiments, a flat bolt may be used to prevent damage to a secured part if the part contacts the bolt. Additionally, or alternatively, a cushion (such as a cushion formed of corrugated plastic sheet material) may be positioned between the nut and bolt. Such a cushion may prevent the bolt from ripping through the structure of the panel to which the securing assembly is mounted and also helps distribute any unwanted point force between the flat bolt and the automotive part.

Once a part is secured in place within the main body, the unit may be picked up and carried using any of the multiple carry handles, which are preferably provided as through holes in the main body that are configured to receive the hand of a user therein. Since parts come in a variety of shapes and sizes, weight distribution varies from part to part. The carry handles preferably are placed at intervals along the height and width of the main body to give a variety of options for lifting the unit, depending on the weight distribution of the part itself. Once the unit is placed in a vehicle, the unit is then secured for delivery. The carry handles then may be used as areas of contact for securing the unit to the vehicle, such as may be accomplished with ratchet straps, for example, that may be inserted through the carry handles.

In some embodiments, a cart specifically adapted for use with a main body may be used to move a unit more easily. Preferably, the cart provides a ramp for ease in moving a main body and secured part onto or off of the cart. In some embodiments, support rungs are provided to give the cart strength and act as a guide for a main body to slide against when being placed into the cart. Once the unit is all the way inside the cart and up against the backstop, the cart may be pivoted backwards for maneuvering. In particular, the user may pull back on the handlebars while also using his/her foot to push down on a bottom step plate to tilt the cart. In some embodiments, the cart incorporates a wheeled axle that functions as a balanced fulcrum for use when positioning the cart while loaded. Specifically, the pivot point of the axle is positioned to allow for the center of mass of the cart and unit to align over the axle. This transfers most of the weight onto the wheels instead of in the user's hands. The overall width of the cart is relatively narrow (that is, not much wider than the main body) to provide easy access to any tight areas during maneuver. Such a configuration is depicted in FIG. 1, in which an example embodiment of an assembly 10 includes a main body 12, within which an automobile door 14 is secured, as well as an optional cart 16, upon which the main body and the door are loaded.

Although one main body may be used for the transport of some parts (for example, a door), in some embodiments, an assembly may include a pair of main bodies to encase a part. By way of example, two main bodies may engage each other in a clamshell configuration. In this regard, when the user is placing a tall part inside the cavity of a main body, some of the part may still be exposed and not fully covered. In such an instance, a second main body may be used in conjunction with the first. With the part inside the cavity of the first main body with the bottom of the first main body beneath the part, a second main body may be inverted and placed above the first. Preferably, the open end of the second main body is positioned adjacent to the end panel of the first main body and within the cavity of the first main body. Thus, the side panels of the second main body nest within the side panels of the first main body. This configuration encapsulates a tall part like a big door or a wide fender so that the part is fully covered for transport. Once the part is placed inside the combined cavities of the two main bodies, the securing assemblies can now be used to hold the part in place. By way of example, one securing assembly may secure the open (front) end of the first main body, while another securing assembly may secure the second main body along with the part to the bottom of the first main body.

As another example, two main bodies may engage each other in an interlocking configuration. In particular, the open end of a second main body may be positioned into the inside of the open end of a first main body, extending the overall length of the cavity. This enables a part like a tailgate or a wide hood to be properly covered for transport. Once the part is positioned inside the combined cavities, securing assemblies may be used hold the part in place. For instance, a securing assembly may wrap around the closed end (back side) of the second main body to secure the second main body from disengaging the first main body. Additionally, one securing assembly from each of the two main bodies may be used to secure a top of the part to prevent movement during transport.

Figure 2:
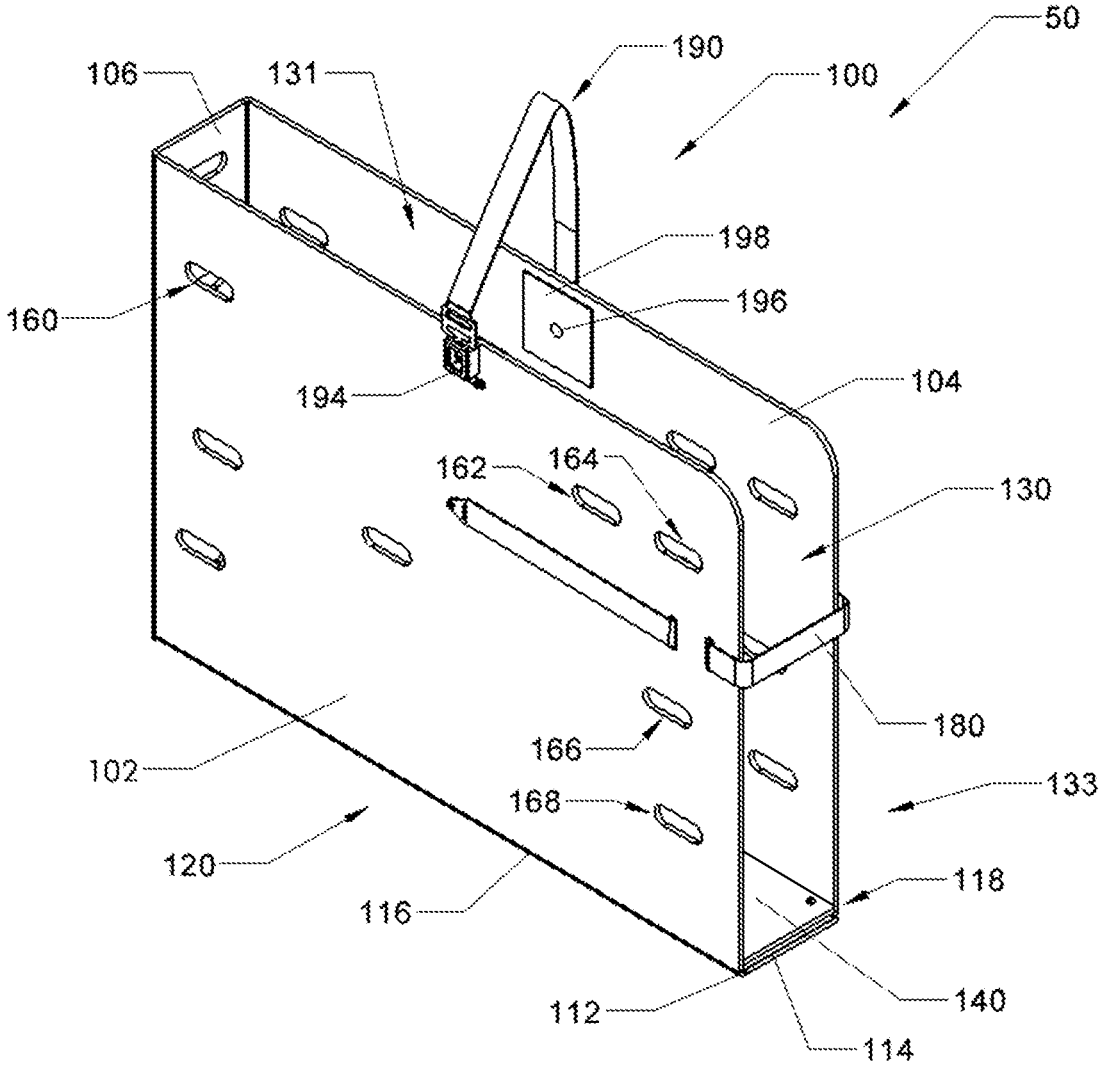
FIG. 2 is a schematic view of an example embodiment of a main body.

With reference to FIGS. 2-11, another example embodiment of an assembly 50 incorporates a main body 100 that includes a first side panel 102, a second side panel 104 and an end panel 106. In the assembled configuration depicted, first side panel 102 and second side panel 104 are oriented in a spaced, overlying relationship with respect to each other with end panel 106 extending between first side panel 102 and second side panel 104. Main body 100 also includes a first flap 112 and a second flap 114, with first flap 112 extending outwardly from a lower edge 116 of first side panel 102, and second flap 114 extending outwardly from a lower edge 118 of second side panel 104. Notably, in the pre-assembled configuration (FIG. 3), first side panel 102, second side panel 104, end panel 106, first flap 112 and second flap 114 are disposed in a planar orientation. In contrast, in the assembled configuration, first flap 112 and second flap 114 are overlapped and secured to form a base 120 (see also, FIG. 5) upon which main body 100 is supported as a freestanding structure that defines a cavity 130. In the embodiment of FIG. 2, cavity 130 communicates with an open top 131 and an adjacent open end 133 of main body 100 so that cavity 130 is configured to receive an automobile door.

Figure 3:
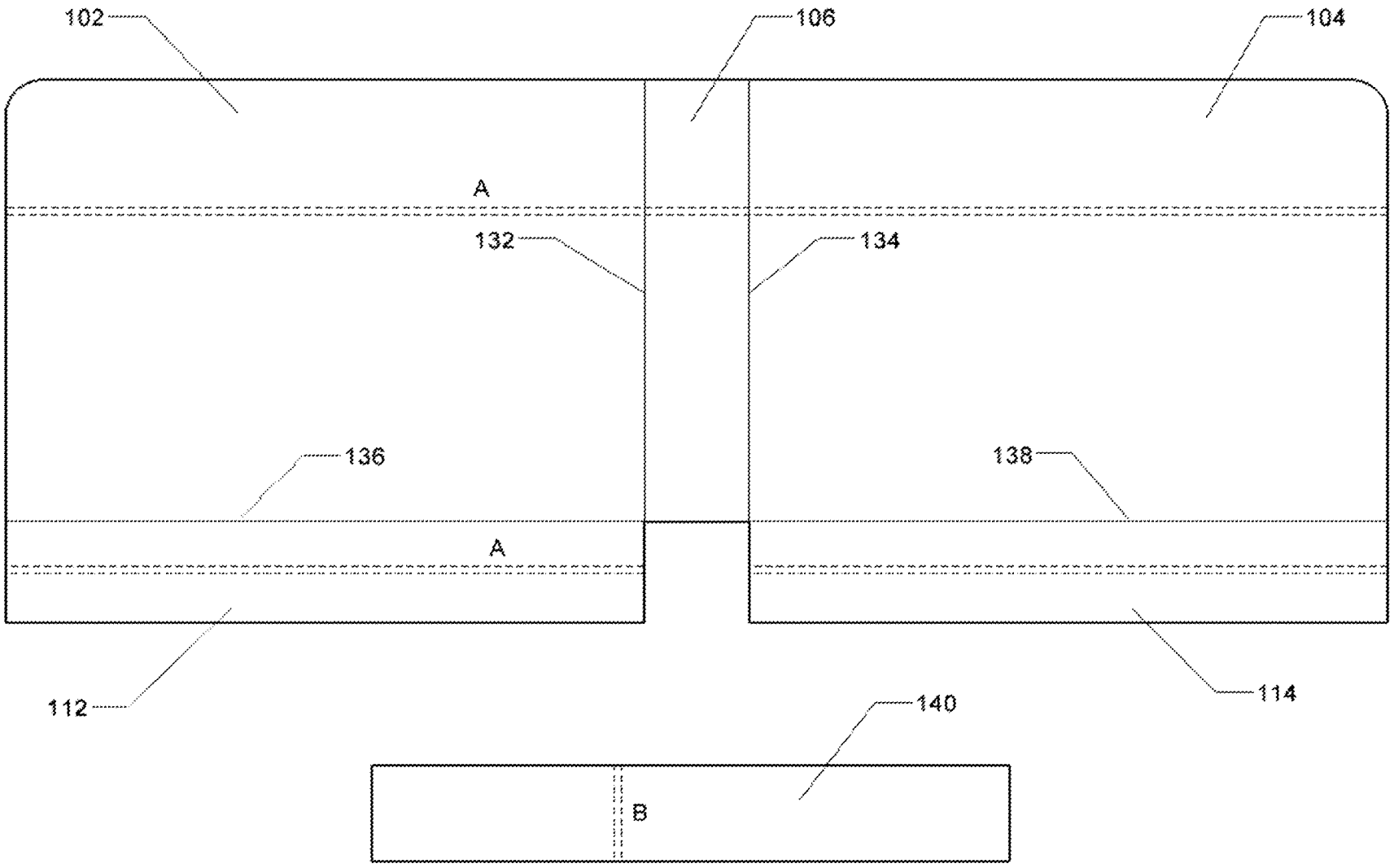
FIG. 3 is a schematic, plan view of a sheet of material used to form an example embodiment of a main body.
Figure 4:
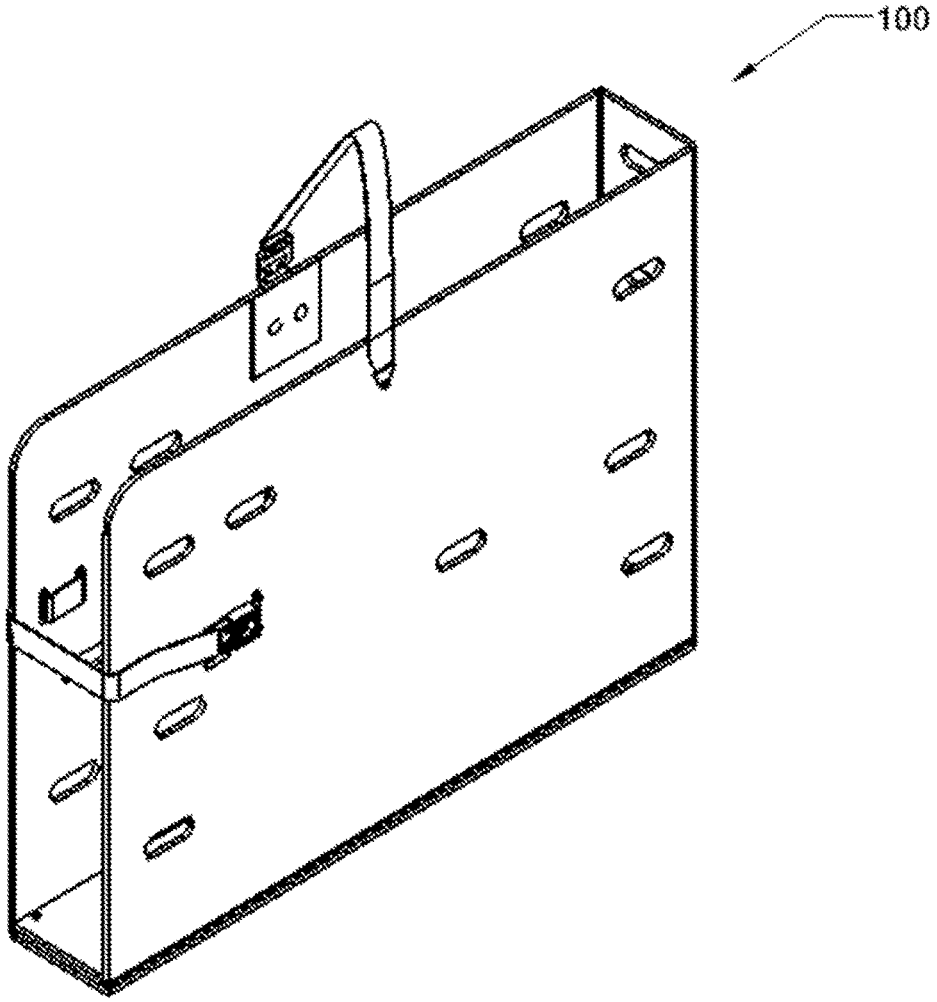
FIGS. 4-7 are schematic views of the embodiment of FIG. 2.
Figure 5:
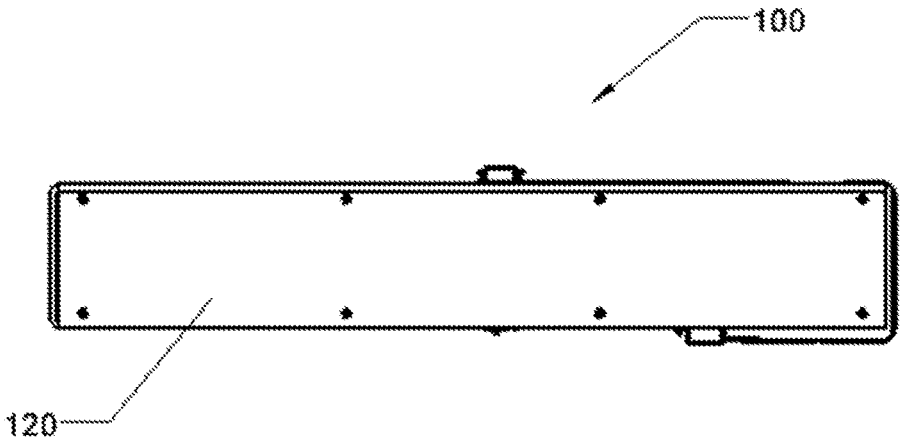
Figure 6:
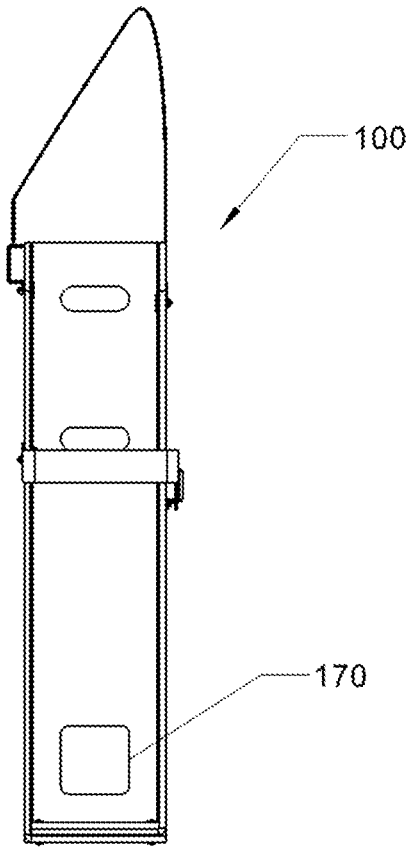
Figure 7:
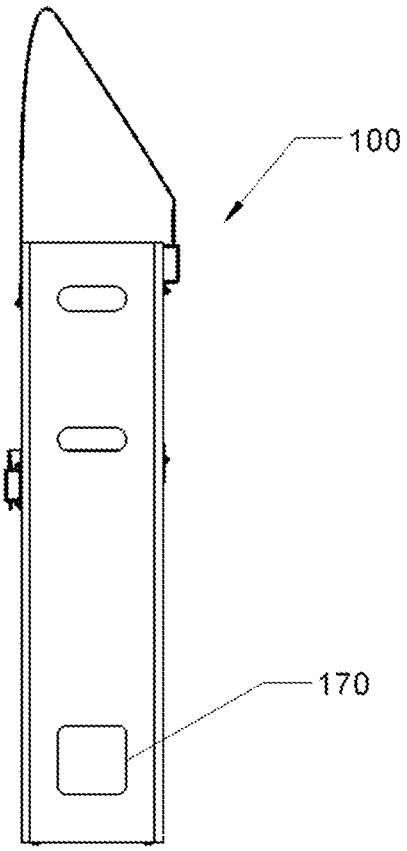
Figure 8:
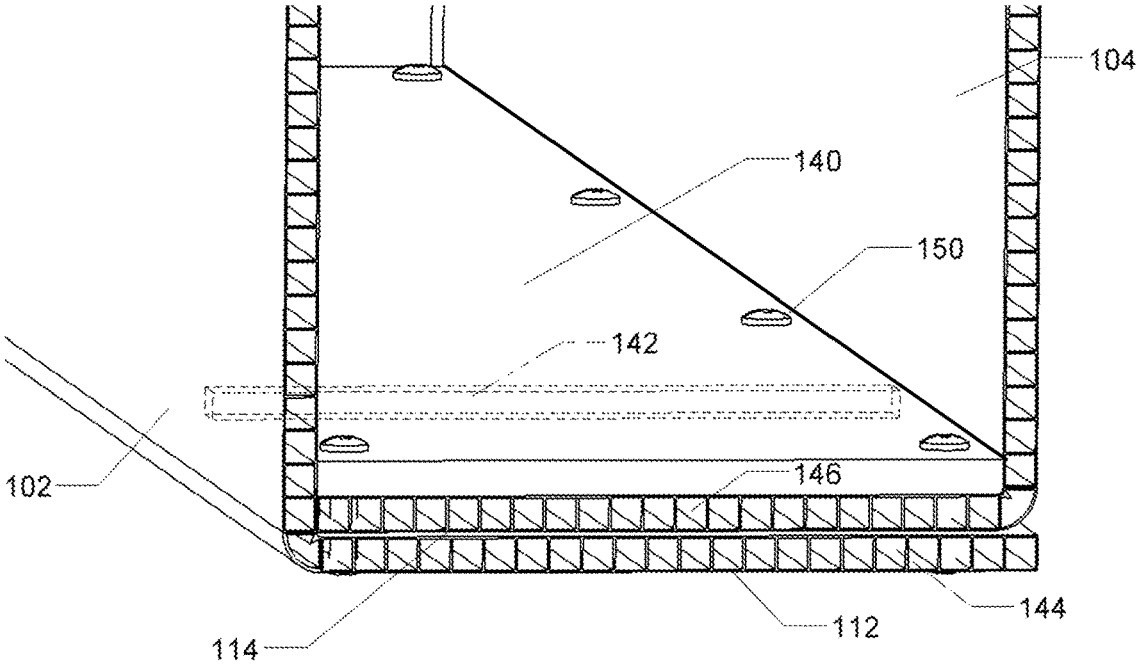
FIG. 8 is a schematic view showing assembly detail of the flaps and floor insert of the embodiment of FIG. 2.

As best shown in FIG. 3, main body 100 additionally incorporates a first linear fold 132 disposed between first side panel 102 and end panel 106, a second linear fold 134 disposed between second side panel 104 and end panel 106, a third linear fold 136 disposed between first side panel 102 and first flap 112, and a fourth linear fold 138 disposed between second side panel 104 and second flap 114. The various folds facilitate arranging of the panels and flaps to form the assembled configuration as main body 100 is formed of a continuous piece of sheet material in this embodiment. In some embodiments, the sheet material is a corrugated plastic sheet material such as fluted polypropylene sheet material. In some embodiments, the corrugated plastic sheet material may be COROPLAST® sheet material, for example, and preferably of a thickness of approximately 10 mm. In particular, in those embodiments using corrugated sheet material, the corrugations or flutes of main body 100 preferably are oriented parallel to third linear fold 136 and fourth linear fold 138 (i.e., in the directions shown by dashed lines A).

Also shown in FIG. 3 is a floor insert 140, which is formed of fluted polypropylene sheet material in this embodiment although other materials may be used. Flutes of the fluted polypropylene sheet material of floor insert 140 preferably are oriented perpendicular to an orientation of flutes of first flap 112 and second flap 114 (i.e., in the directions shown by dashed lines B). In the assembled configuration (FIG. 8), floor insert 140 is disposed in an overlying relationship with first flap 112 and second flap 114, and extends from end panel 106 to open end 133 of main body 100. As such, the flutes (e.g., flute 142 of floor insert 140) cross the flutes (e.g., flutes 144 and 146) of flaps 112 and 114. Note also that floor insert 140 is a removable floor insert with removable attachment of floor insert 140 being facilitated by mechanical fasteners (e.g., mechanical fastener 150) such as bolt/nut assemblies.

Main body 100 also incorporates a plurality of through holes (e.g., through holes 160, 162) configured as carry handles (FIG. 2). Specifically, the through holes are disposed in the panels and are suitable in size and shape for a user to grasp the main body by placing a portion of their hand (e.g., fingers) into a through hole for lifting or pulling the main body. The through holes preferably are located at intervals along the height and width of main body 100 to provide give a range of options for grasping. For instance, for parts of varying weigh from front-to-back with respect to main body 100, a user may choose between through holes 160, 162 and 164 positioned at similar heights but different longitudinal locations. In this embodiment, multiple though holes also are provided at varying heights at the similar longitudinal locations (e.g., through holes 164, 166 and 168). The through holes also may be used as areas of contact for securing the unit to the vehicle, such as may be accomplished by synching tie-down straps through the through holes.

Toward the bottom of end panel 106, another through hole 170 is provided. In this embodiment, through hole 170 is a larger square-shaped through hole that is used as an access hole during assembly to provide access to mechanical fastener 150. Through hole 170 may also be used for lifting or pulling the main body during transport.

Figure 9:
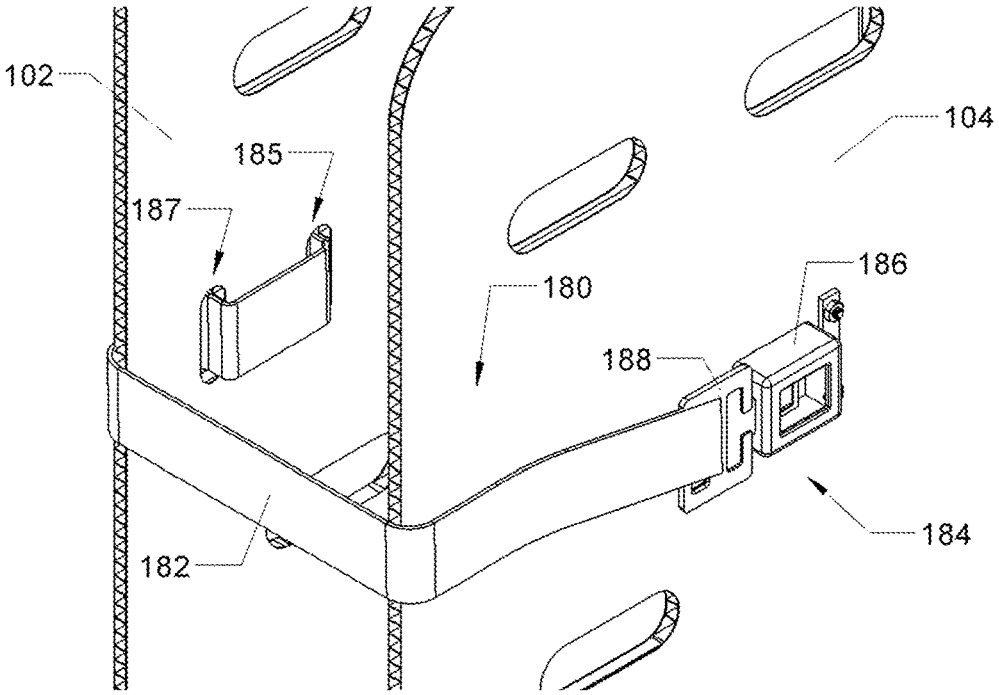
FIG. 9 is a schematic view showing assembly detail of a securing assembly of the embodiment of FIG. 2.
Figure 10:
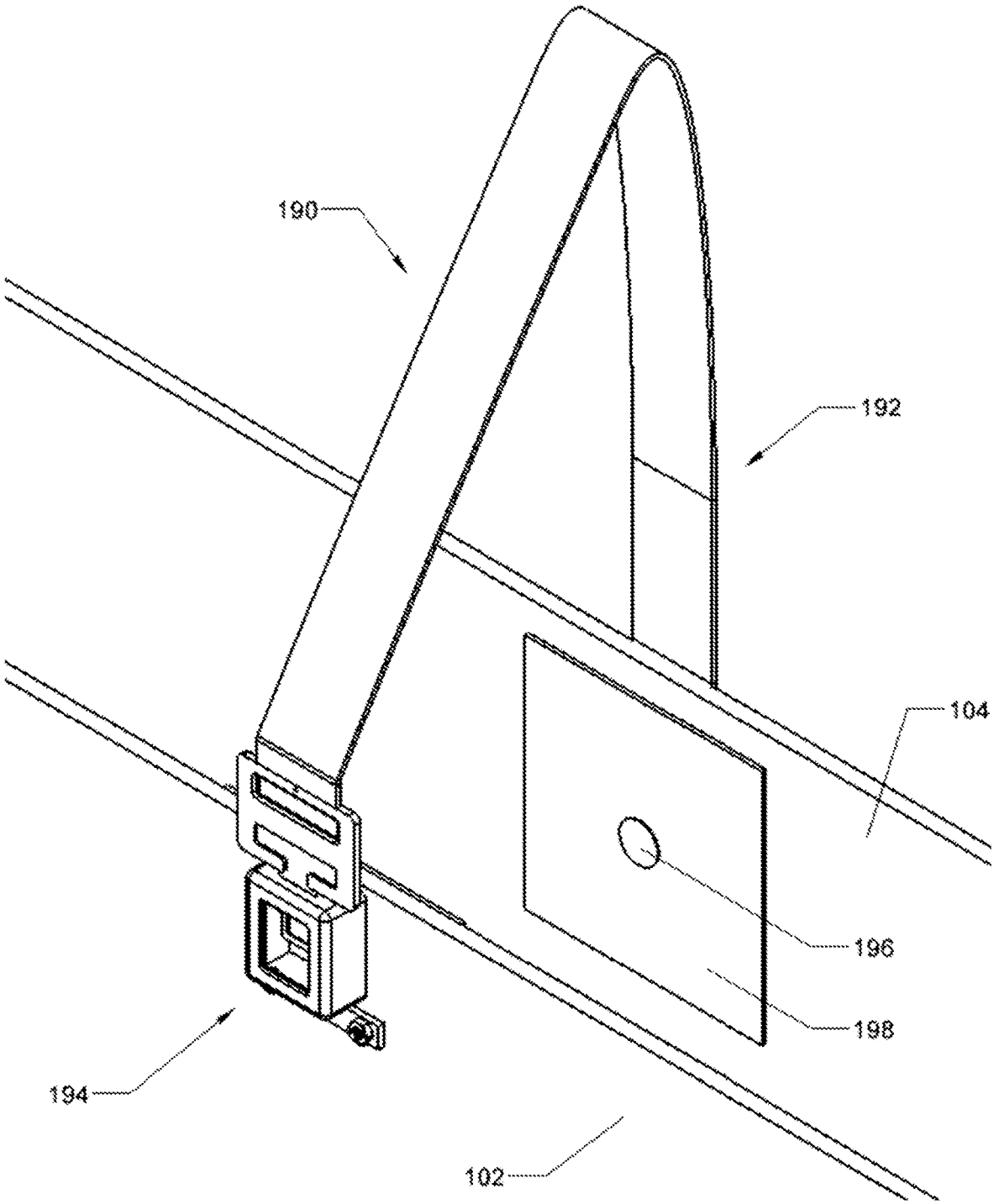
FIG. 10 is a schematic view showing assembly detail of another securing assembly of the embodiment of FIG. 2.

With continued reference to FIG. 2, as well as FIGS. 9 and 10, some embodiments incorporate the use of a first securing assembly 180 and a second securing assembly 190. First securing assembly 180 includes a first securing component 182 attached to first side panel 102 and a second securing component 184 attached to second side panel 104. First securing component 182 and second securing component 184 are configured to selectively engage each other to secure a part within cavity 130. Similarly, second securing assembly 190 includes a third securing component 192 attached to second side panel 104 and a fourth securing component 194 attached to first side panel 102. Third securing component 192 and fourth securing component 194 also are configured to selectively engage each other to secure a part within cavity 130.

Figure 11:
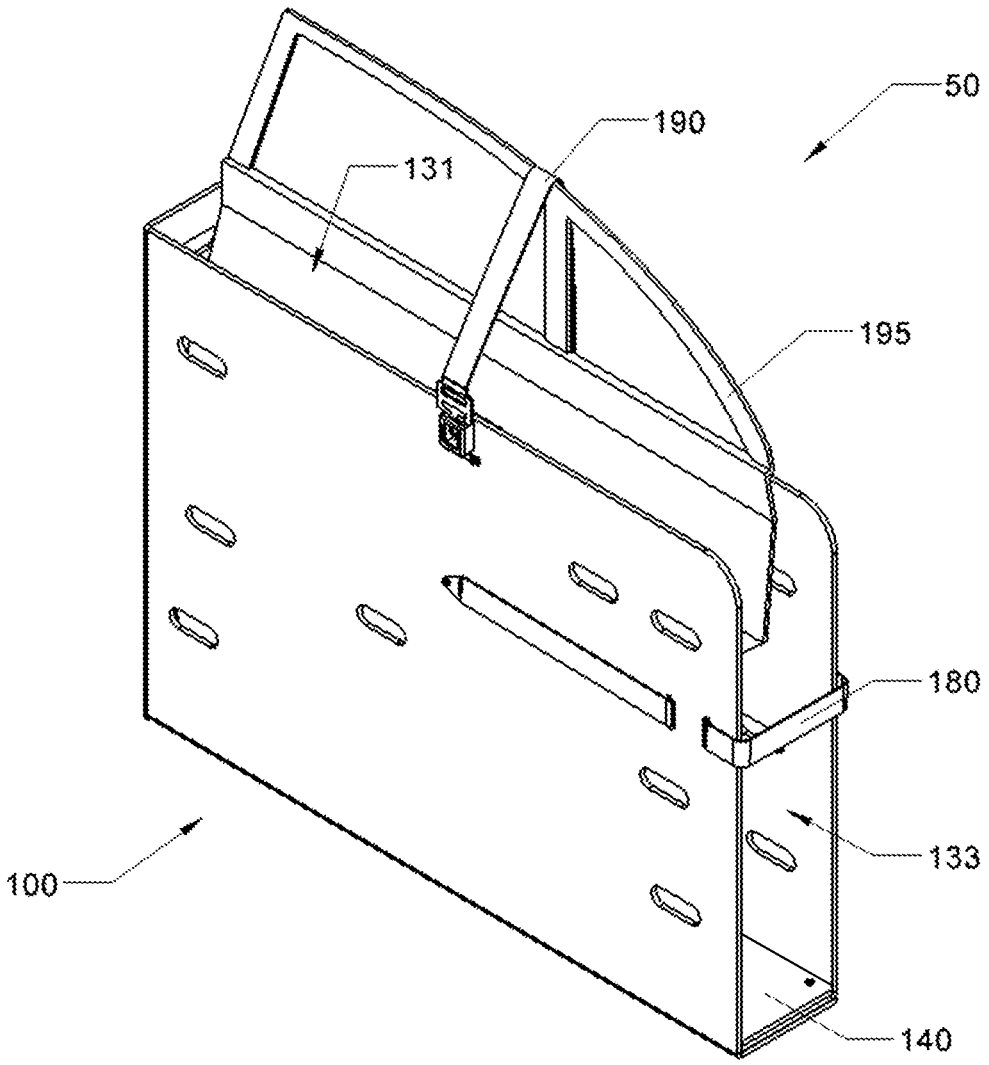
FIG. 11 is a schematic view of the embodiment of FIG. 2 showing a representative automobile part secured within the cavity.

In some embodiments, the securing assemblies are formed of adjustable belts (for example, automobile seatbelts). Preferably, first securing assembly 180 (FIG. 9), when in an engaged configuration (FIG. 11), spans across open end 133 and is used to secure a part (for example, a door 195) from sliding out of the open end 133 of the main body. Support slots 185, 187 (FIG. 9) also are provided along a path of extension of first securing component 182 to help prevent the belt portion from dragging along the ground when not in use (that is, when in the disengaged configuration). In contrast, second securing assembly 190 (FIG. 10) preferably spans across open top 131 of main body 100 when in the engaged configuration and is used to ground a part to floor insert 140 (FIG. 11). It should be noted that using automobile seatbelts to form the securing assemblies provides associated latching mechanisms (e.g., buckle 186 and latch 188) that enable convenient securing and removal of a part from the main body.

Preferably, securing assemblies are attached to the main body with mechanical fasteners (for example, nuts and bolts). In some embodiments, a flat-headed bolt (e.g., elevator bolt 196) may be used to prevent damage to a secured part if the part contacts the bolt. A cushion 198 also may be positioned between the flat end of bolt 196 and a corresponding nut. Such a cushion, which may be formed of corrugated plastic sheet material in some embodiments, may help prevent the bolt from ripping through the structure of the panel to which the securing assembly is mounted and may also help distribute any unwanted point force between the bolt and the carried part.

Figure 12:
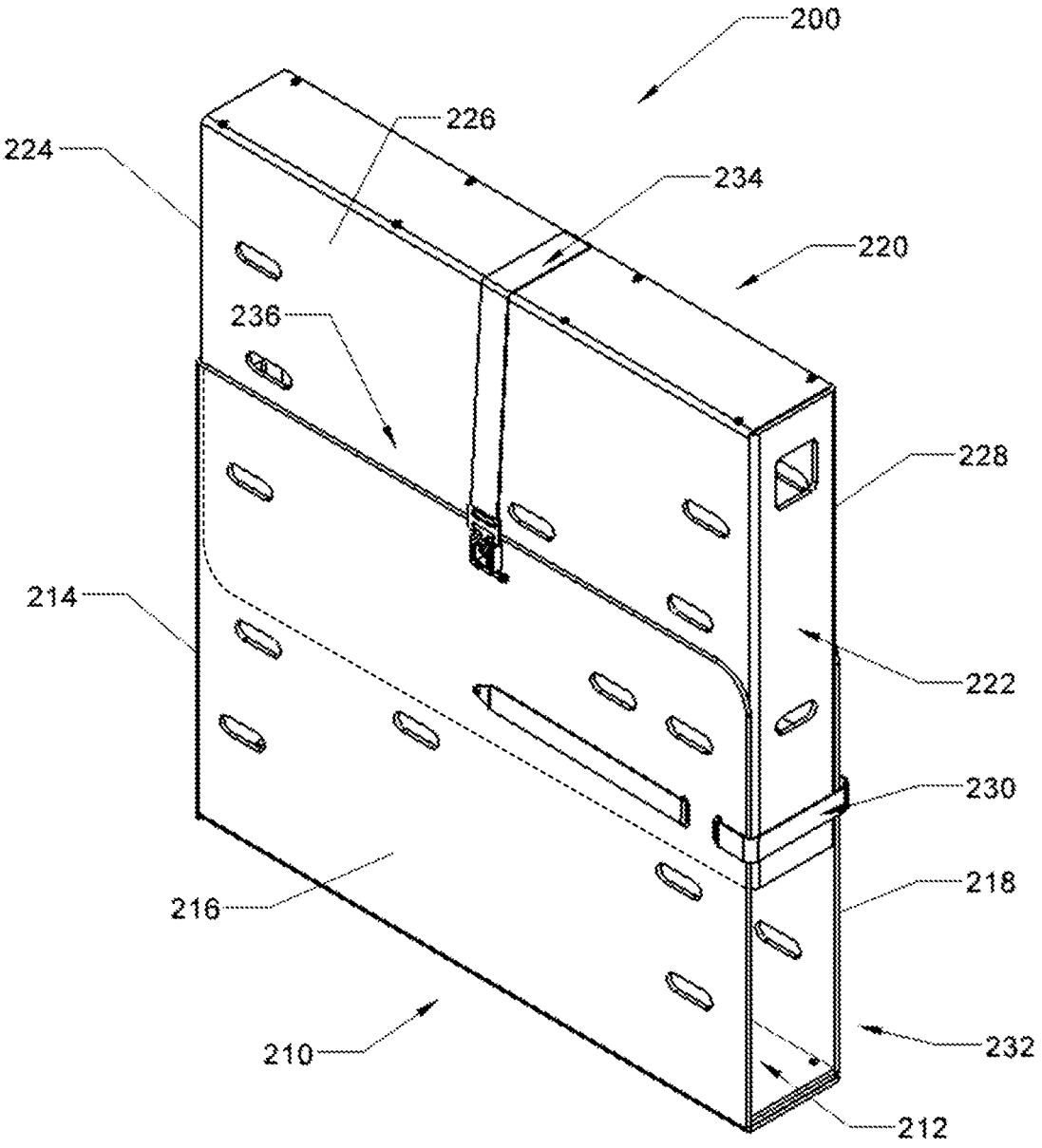
FIG. 12 is a schematic view of an example embodiment of an assembly with two main bodies engaged in a clamshell configuration.

As mentioned previously, an assembly may include a pair of main bodies to encase a part in some embodiments. An example of such an embodiment is shown in FIG. 12, in which an assembly 200 incorporates main bodies 210, 220 that engage each other in a clamshell configuration. In some of these embodiments, the main bodies may be identical to each other.

Main body 210 defines a cavity 212 and main body 220 defines cavity 222. In use, cavity 212 is configured to receive, at least partially, main body 220. In particular, open end 224 of main body 220 is positioned adjacent to end panel 214 of main body 210 and within cavity 212 with side panels 226, 228 of main body 220 nesting within side panels 216, 218 of main body 210. This configuration may be used to encase a tall part that may otherwise extend upwardly from main body 210 if only that main body were used.

Once the part is placed inside the combined cavities (212, 222), securing assemblies are used to hold the part in place. By way of example, securing assembly 230 of main body 210 may secure open (front) end 232 of main body 210, and securing assembly 234 may secure open top 236, as well as main body 220 (along with any carried part(s)).

Figure 13:
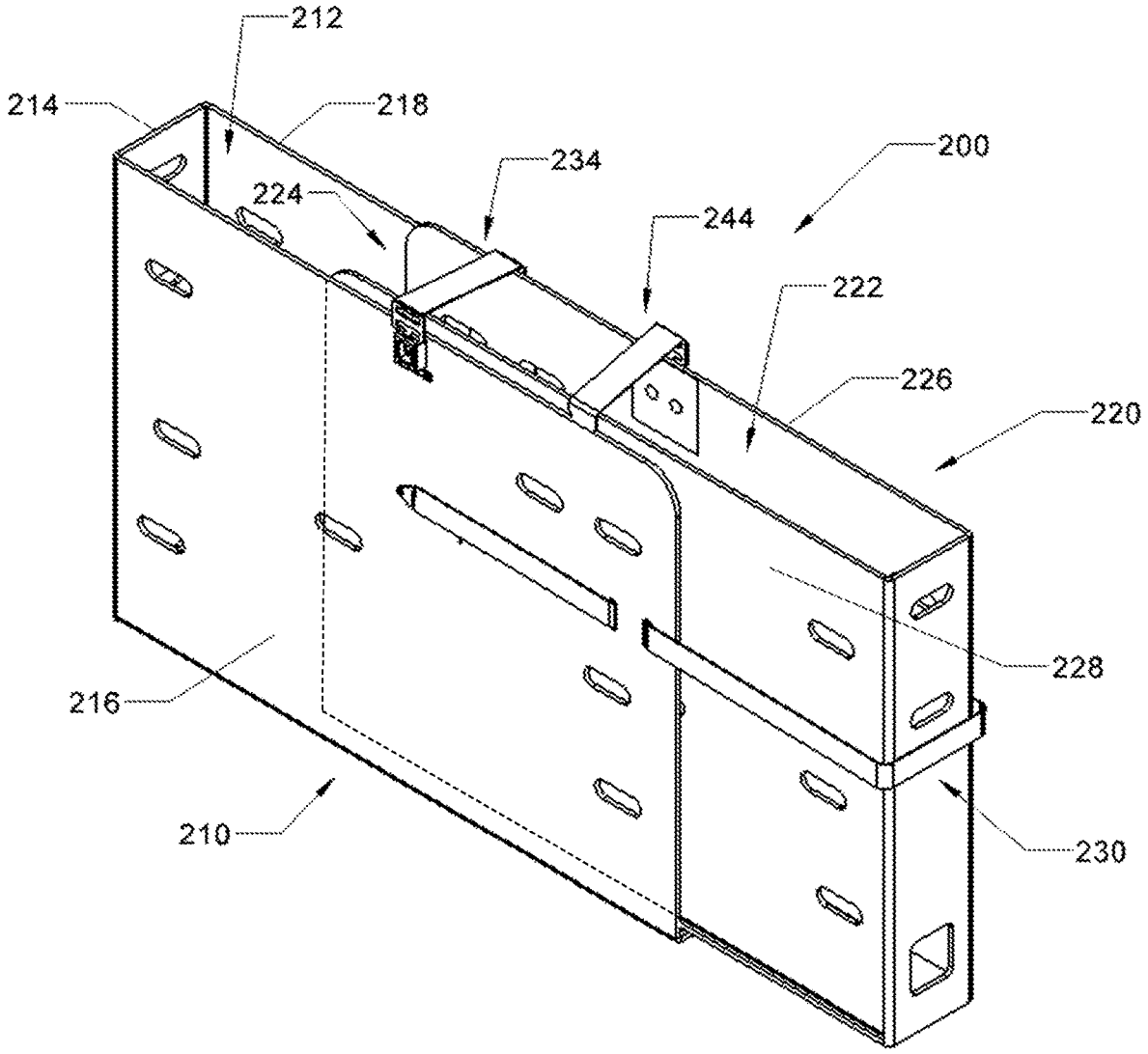
FIG. 13 is a schematic view of an example embodiment of an assembly with two main bodies engaged in an interlocking configuration.

As another example, main bodies 210, 220 are shown in FIG. 13 engaging each other in an interlocking configuration. In particular, while both main bodies are oriented upright, open end 224 of main body 220 is positioned within cavity 212 of main body 210 to extend the overall length of the combined cavities (212, 222). Preferably, side panels 226, 228 of main body 220 nest within side panels 216, 218 of main body 210. Securing assembly 230 may be used to prevent main body 220 from disengaging main body 210 longitudinally (i.e., through open end 232). Additionally, securing assembly 234 of main body 210 and securing assembly 244 of main body 220 may be used to prevent main body 220 from disengaging main body 210 vertically (i.e., through open top 236).

Figure 14:
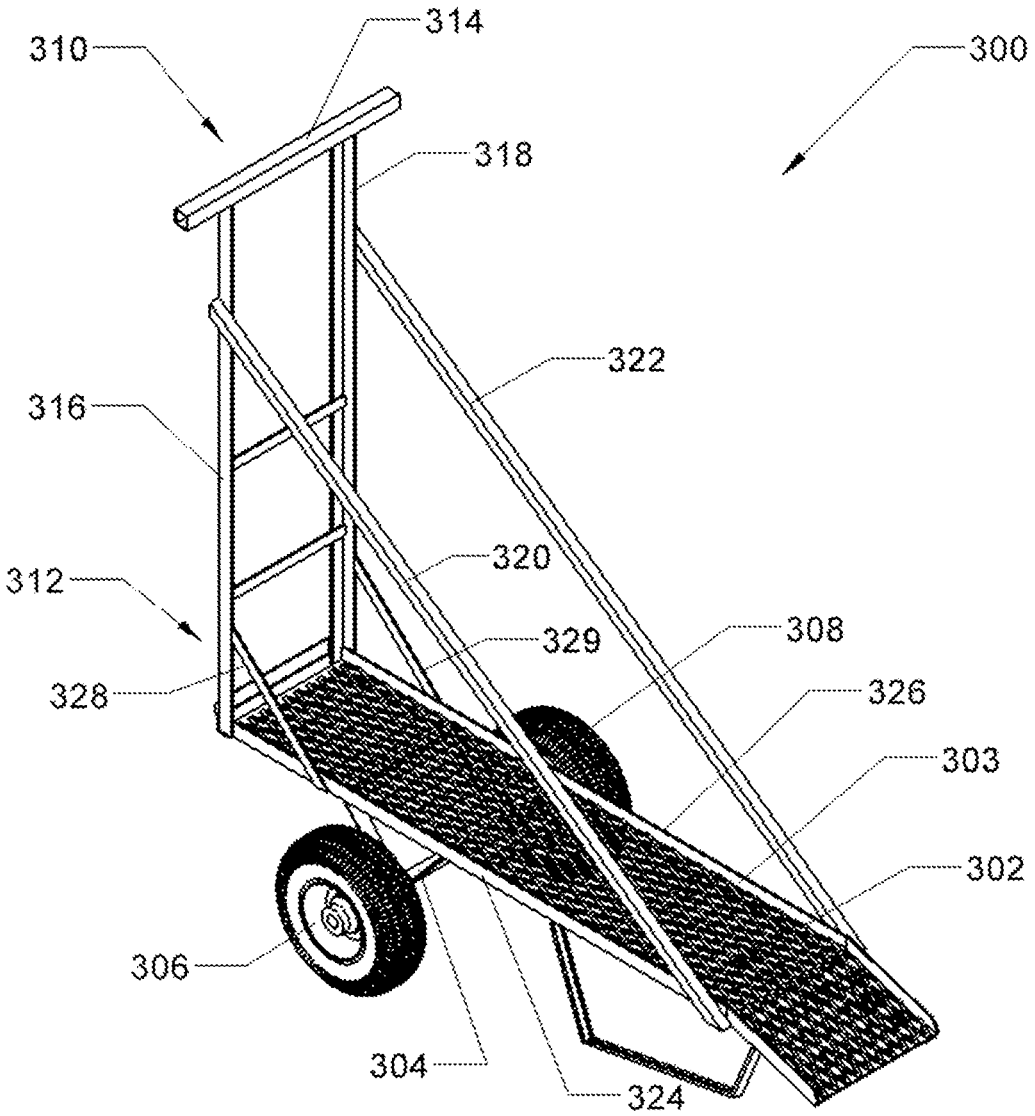
FIG. 14 is a schematic view of an example embodiment of a cart.
Figure 15:
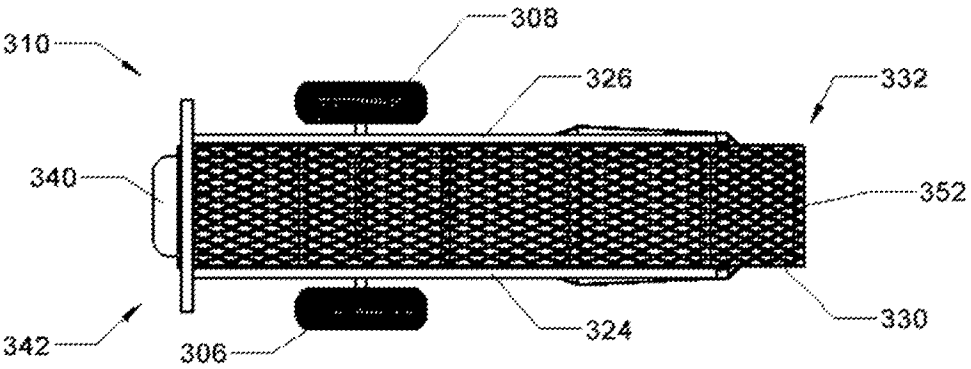
FIGS. 15-19 are schematic views of the embodiment of FIG. 14.
Figure 17:
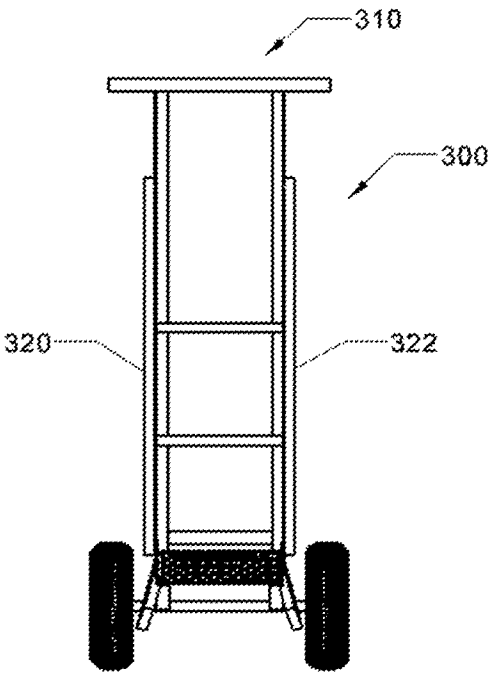
Figure 16:
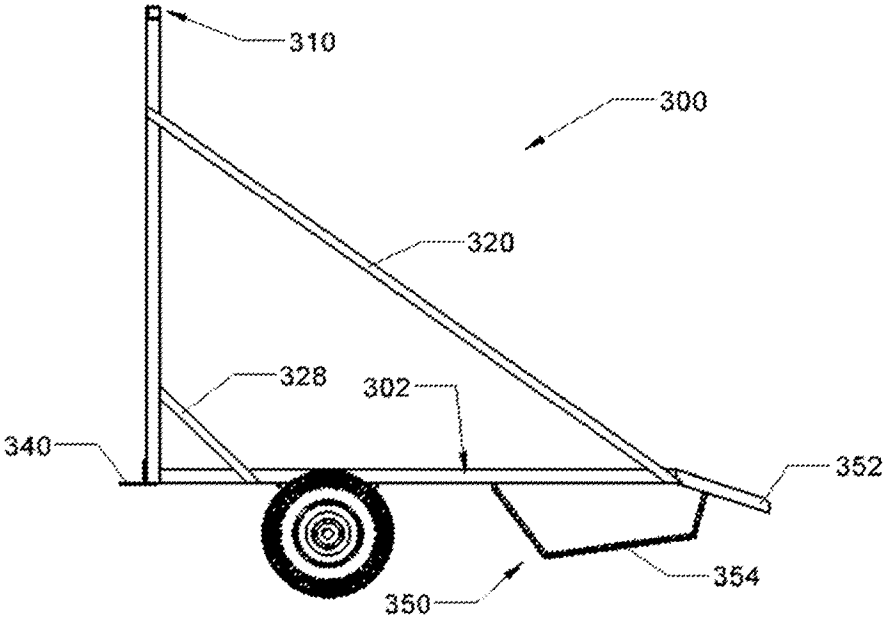
Figure 18:
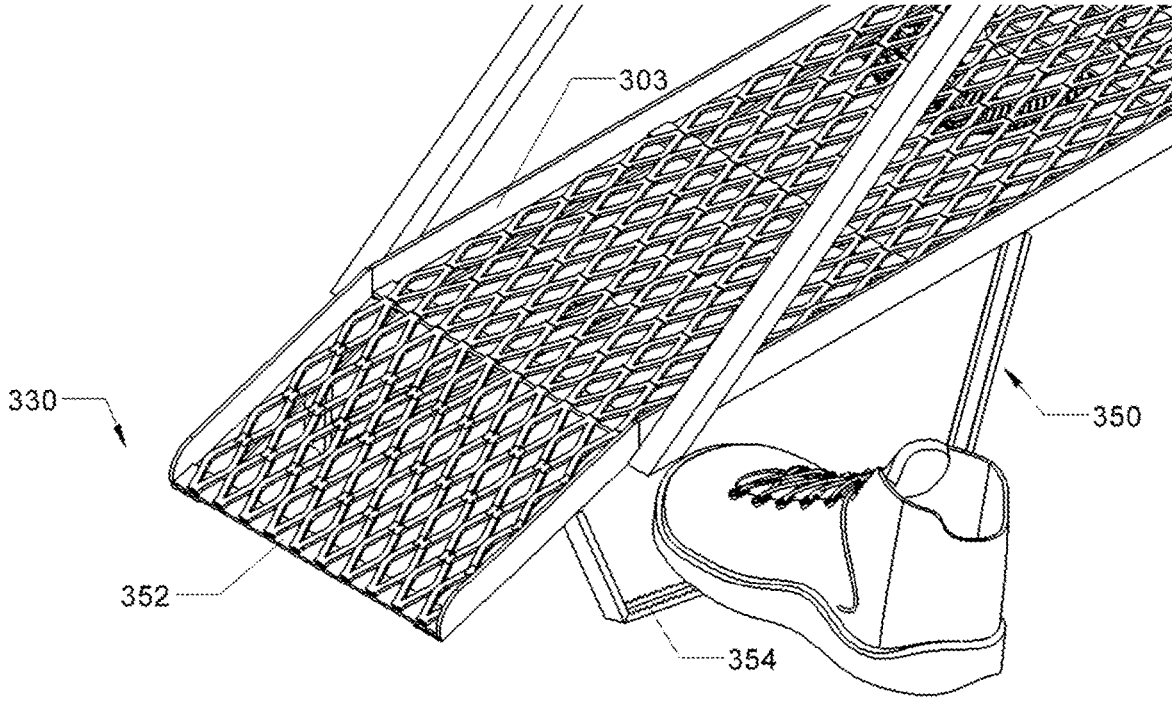
Figure 19:
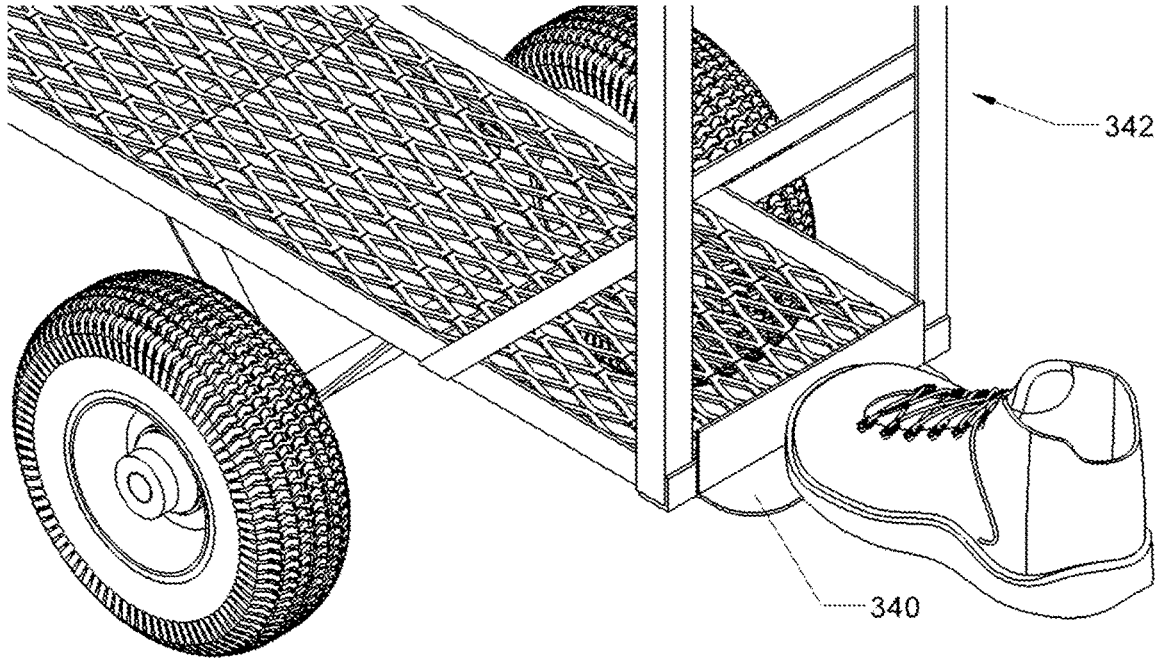

As also mentioned previously, an assembly may incorporate a cart in some embodiments. An example embodiment of a cart 300 is depicted in FIG. 14. Specifically, cart 300 incorporates a platform 302 that is sized and shaped to accommodate placement of a main body in an upright orientation. Preferably, platform 302 includes a raised perimeter edge 303 that maintains the position of a load placed upon the platform. Platform 302 also incorporates expanded metal sheets to provide grip to the bottom of main body 100. An axle 304 is disposed under and mounted to platform 302. Axle 304 is configured to rotate and is attached to wheels (306, 308).

A handle assembly 310 extends upwardly from a first end 312 of platform 302, serving as a backstop, terminating in a handle bar 314.

Struts 316, 318 extend from opposing side bars 320, 322 of handle assembly 310 and attach to opposing sides 324, 326 of the platform. Spacing between struts 316, 318 is configured to support the side panels of a main body when disposed on the platform. In some embodiments, auxiliary struts 328, 329 are provided to enhance strength and rigidity.

As shown with reference to FIGS. 15-19, the depicted embodiment cart includes a ramp 330 that extends downwardly from a receiving end 332 of the platform. Ramp 330 permits ease in moving a main body onto or off of platform 302.

In use, once a main body is properly stowed on cart 300 (that is, placed on the platform and up against the backstop), cart 300 may be pivoted backwards for maneuvering. In particular, the user may pull back on handle bar 314 while also using his/her foot to push down on a leverage component (step plate) 340 extending outwardly from the handled end (first end) 342 of platform 302. Notably, axle 304 functions as a balanced fulcrum for use when positioning the cart.

Cart 300 also incorporates a stabilizing component 350 that is disposed under platform 302 in this embodiment. Stabilizing component 350 is configured to contact a surface upon which the cart is positioned when in a loading position, at which a distal end 352 ramp 330 also is in contact with the surface. Stabilizing component 350 includes a step portion 354 that is configured to receive thereon a foot of a user to stabilize cart 300 during loading and/or unloading.

Figure 20:
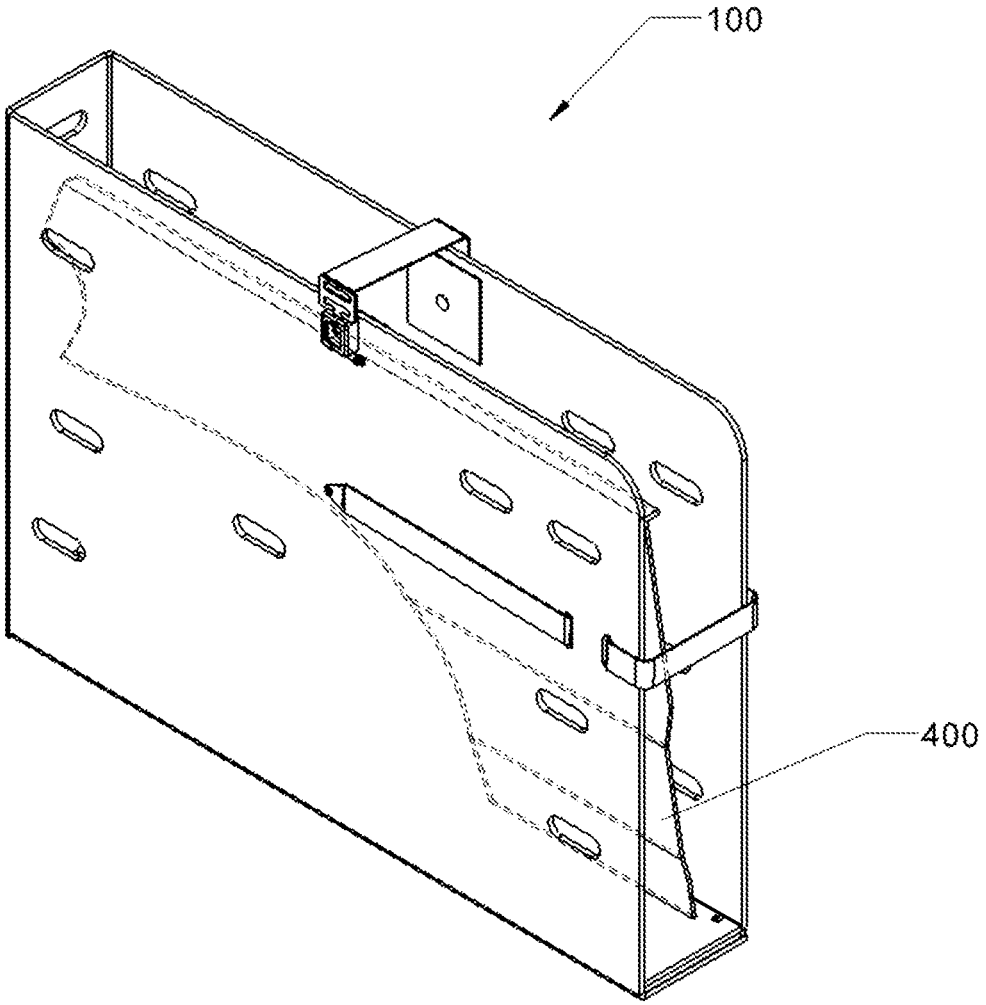
FIG. 20 is a schematic view of the embodiment of FIG. 2 with a part that completely fits within the cavity.

FIG. 20 is a schematic view of the assembly 100 of FIG. 2. However, unlike the previous descriptions, which have generally referred to automobile doors as the part being transported, FIG. 20 shows a part that completely fits within the cavity of the main body. In this case, the part is an automobile fender 400.

Although preferred embodiments have been illustrated in the accompanying Drawings and described in the foregoing Detailed Description, it should be understood the disclosure is not limited to the embodiments disclosed but is capable of rearrangement, modification, and/or substitution of parts and elements without departing from the spirit of the disclosure.

I claim:

1. An assembly for protecting an automobile part, comprising:

a main body formed of a continuous piece of sheet material having a first side panel, a second side panel, an end panel, a first flap, a second flap, a first linear fold, a second linear fold, a third linear fold and a fourth linear fold, the end panel being disposed between the first side panel and the second side panel, the first flap extending outwardly from a lower edge of the first side panel, the second flap extending outwardly from a lower edge of the second side panel, the first linear fold being disposed between the first side panel and the end panel, the second linear fold being disposed between the second side panel and the end panel, the third linear fold being disposed between the first side panel and the first flap, the fourth linear fold being disposed between the second side panel and the second flap, and the sheet material being fluted polypropylene sheet material having flutes oriented parallel to the third linear fold and the fourth linear fold;

a removable floor insert formed of fluted polypropylene sheet material; and mechanical fasteners configured to secure the removable floor insert to the main body;

the main body selectively exhibiting a pre-assembled configuration, in which the first side panel, the second side panel, the end panel, the first flap and the second flap are oriented in a first plane, and an assembled configuration, in which the first side panel and the second side panel are oriented in an overlying relationship with respect to each other with the end panel extending therebetween, and the first flap and the second flap are overlapped and secured to form a base upon which the main body is supported as a freestanding structure;

in the assembled configuration, the main body defining a cavity configured to receive the automobile part and the removable floor insert being disposed in an overlying relationship with the first flap and the second flap, the removable floor insert extending lengthwise from the end panel to an open end of the main body and extending laterally from the first side panel to the second side panel, the removable floor insert having flutes oriented perpendicular to an orientation of flutes of the first flap and the second flap;

wherein the removable floor insert is selectively secured to the main body by the mechanical fasteners received within corresponding through-holes, which are formed in the removable floor insert, the first flap and the second flap, and which are aligned to receive the mechanical fasteners.

2. The assembly of claim 1, further comprising a plurality of through holes formed in the main body, each of the plurality of through holes being configured as a carry handle.

3. The assembly of claim 1, further comprising a first securing assembly having a first securing component attached to the first side panel and a second securing component attached to the second side panel, the first securing component and the second securing component being configured to selectively engage each other to secure an automobile door within the cavity.

4. The assembly of claim 3, wherein the first securing component and the second securing component each include a corresponding latching mechanism of an automobile seat belt.

5. The assembly of claim 3, wherein:

the assembly further comprises has a second securing assembly having a third securing component attached to the first side panel and a fourth securing component attached to the second side panel; and the third securing component and the fourth securing component are configured to selectively engage each other to secure the automobile part within the cavity.

6. The assembly of claim 5, wherein:

when the first securing component and the second securing component are engaged, the first securing assembly spans across an open end of the main body; and when the third securing component and the fourth securing component are engaged, the second securing assembly spans across an open top of the main body.

7. The assembly of claim 1, wherein:

the main body is a first main body defining a first cavity;

the assembly further comprises a second main body defining a second cavity; and the first cavity is configured to receive, at least partially therein, the second main body.

8. The assembly of claim 7, wherein the second main body is identical to the first main body.

9. The assembly of claim 1, wherein:

the assembly further comprises a cart having a platform, an axle disposed under and mounted to the platform, a handle assembly extending upwardly from a first end of the platform, and a first strut and a second strut extending from opposing sides of the handle assembly to opposing sides of the platform; and spacing between the first strut and the second strut is configured to support the first side panel and the second side panel when the main body disposed on the platform.

10. The assembly of claim 9, wherein the cart further comprises a ramp downwardly extending from a receiving end of the platform.

11. The assembly of claim 10, wherein the cart further comprises a stabilizing component disposed under the platform, the stabilizing component being configured to contact a surface upon which the cart is positioned when in a loading position, at which a distal end of the ramp also is in contact with the surface, the stabilizing component being configured to receive thereon a foot of a user to stabilize the cart during loading.

12. The assembly of claim 9, wherein the cart further comprises a leverage component extending outwardly from the platform and away from the first end, the leverage component being configured to receive thereon a foot of a user to assist in rotating the platform about the axle.

13. The assembly of claim 1, wherein at least a portion of each of the mechanical fasteners extends outwardly from an outer surface of the main body.

14. The assembly of claim 1, further comprising:

a bolt configured to attach the first securing component to the first side panel; and a layer of fluted polypropylene sheet material, disposed between a portion of the bolt and an inward-facing surface of the first side panel, configured to prevent the bolt from ripping the first side panel.

* * * * *